US006827611B1

(12) United States Patent
Payne et al.

(10) Patent No.: US 6,827,611 B1
(45) Date of Patent: Dec. 7, 2004

(54) ELECTRICAL CONNECTOR WITH MULTI-BEAM CONTACT

(75) Inventors: Jason J. Payne, Nashua, NH (US); Thomas S. Cohen, New Boston, NH (US); John R. Dunham, Nashua, NH (US); Mark W. Gailus, Somerville, MA (US); Philip T. Stokoe, Attleboro, MA (US)

(73) Assignee: Teradyne, Inc., Boston, MA (US)

( * ) Notice: Subject to any disclaimer, the term of this patent is extended or adjusted under 35 U.S.C. 154(b) by 0 days.

(21) Appl. No.: 10/464,166

(22) Filed: Jun. 18, 2003

(51) Int. Cl.[7] ..... H01R 13/648
(52) U.S. Cl. ..... 439/608; 439/609
(58) Field of Search ..... 439/608, 609

(56) References Cited

U.S. PATENT DOCUMENTS 5,993,259 A 11/1999 Stokoe et al. ..... 439/608
6,227,882 B1 * 5/2001 Ortega et al. ..... 439/101
6,394,822 B1 5/2002 McNamara ..... 439/108
6,478,624 B2 * 11/2002 Ramey et al. ..... 439/608
6,482,038 B2 * 11/2002 Olson ..... 439/608
6,506,076 B2 1/2003 Cohen et al. ..... 439/608
6,565,387 B2 5/2003 Cohen ..... 439/608

* cited by examiner

*Primary Examiner*—Hae Moon Hyeon
(74) *Attorney, Agent, or Firm*—Teradyne Legal Department

(57) ABSTRACT

A shielded electrical connector in which multi-beam contacts are used to improve performance of the connector. The beams are positioned to create multiple current paths through a shield member, thereby increasing the effectiveness of the shield. These contacts are used in a connector that has individual shield strips running in parallel with signal conductors. Multiple contact tails are also used to create multiple current paths. Projections from the shield strips shield adjacent signal contacts and the contact portions are positioned to increase current flow through the projections. Structures to allow beam-type contacts to be formed in a small space are also disclosed. The contact structure also reduces the impedance of the ground path.

6 Claims, 7 Drawing Sheets

ELECTRICAL CONNECTOR WITH MULTI-BEAM CONTACT

CROSS-REFERENCES TO RELATED APPLICATIONS

Not Applicable.

STATEMENT REGARDING FEDERALLY SPONSORED RESEARCH OR DEVELOPMENT

Not Applicable.

REFERENCE TO MICROFICHE APPENDIX

Not Applicable

BACKGROUND OF THE INVENTION

1. Field of the Invention

This invention relates generally to electrical connectors and more specifically to high-speed, high-density electrical connectors.

2. Description of Related Art

Electrical connectors are used in many electronic systems. It is generally easier and more cost effective to manufacture a system on several printed circuit boards that are then joined together with electrical connectors. A traditional arrangement for joining several printed circuit boards is to have one printed circuit board serve as a backplane. Other printed circuit boards, called daughter boards, are connected through the backplane.

A traditional backplane is a printed circuit board with many connectors. Conducting traces in the printed circuit board connect to signal pins in the connectors so that signals may be routed between the connectors. Other printed circuit boards, called "daughter boards" also contain connectors that are plugged into the connectors on the backplane. In this way, signals are routed among the daughter boards through the backplane. The daughter cards often plug into the backplane at a right angle. The connectors used for these applications contain a right angle bend and are often called "right angle connectors."

Connectors are also used in other configurations for interconnecting printed circuit boards and even for connecting cables to printed circuit boards. Sometimes, one or more small printed circuit boards are connected to another larger printed circuit board. The larger printed circuit board is called a "mother board" and the printed circuit boards plugged into it are called daughter boards. Also, boards of the same size are sometimes aligned in parallel. Connectors used in these applications are sometimes called "stacking connectors" or "mezzanine connectors."

Regardless of the exact application, electrical connector designs have generally needed to mirror trends in the electronics industry. Electronic systems generally have gotten smaller and faster. They also handle much more data than systems built just a few years ago. To meet the changing needs of these electronic systems, some electrical connectors include shield members. Depending on their configuration, the shields might control impedance or reduce cross talk so that the signal contacts can be placed closer together or carry higher speed signals with the required signal integrity.

U.S. Pat. No. 5,993,259 entitled High Speed, High Density Electrical Connector, to Stokoe et al. is an example of a shielded connector. The assignee of that patent, is Teradyne, Inc. sells a product known as VHDMe. Another example of a high speed, high density connector is described in U.S. Pat. No. 6,506,076 entitled Connector with Egg-Crate Shielding, to Cohen, et al. The assignee of that patent sells a product known as GbX®. A further example is U.S. Pat. No. 6,394,822 to McNamara entitled "Electrical Connector." The assignee of that patent sells a product known as NexLev®.

It would be highly desirable to increase the speed or density of such a connector.

BRIEF SUMMARY OF THE INVENTION

With the foregoing background in mind, it is an object of the invention to provide an improved high speed, high density connector.

To achieve the foregoing object, as well as other objectives and advantages, separable contacts are made to increase the current flow through portions of the shield members. The preferred embodiment uses multiple beams. In one embodiment, the beams are formed to provide current flow in opposite directions in opposing beams.

In the preferred embodiment, the contacts are formed in a shield member that has a projection. The beams are attached to the shield member at different locations to provide multiple current paths through the shield member, thereby increasing current flow through the projection.

BRIEF DESCRIPTION OF THE DRAWINGS

Additional objects, advantages, and novel features of the invention will become apparent from a consideration of the ensuing description and drawings, in which.

DETAILED DESCRIPTION OF THE PREFERRED EMBODIMENT

Figure 1:
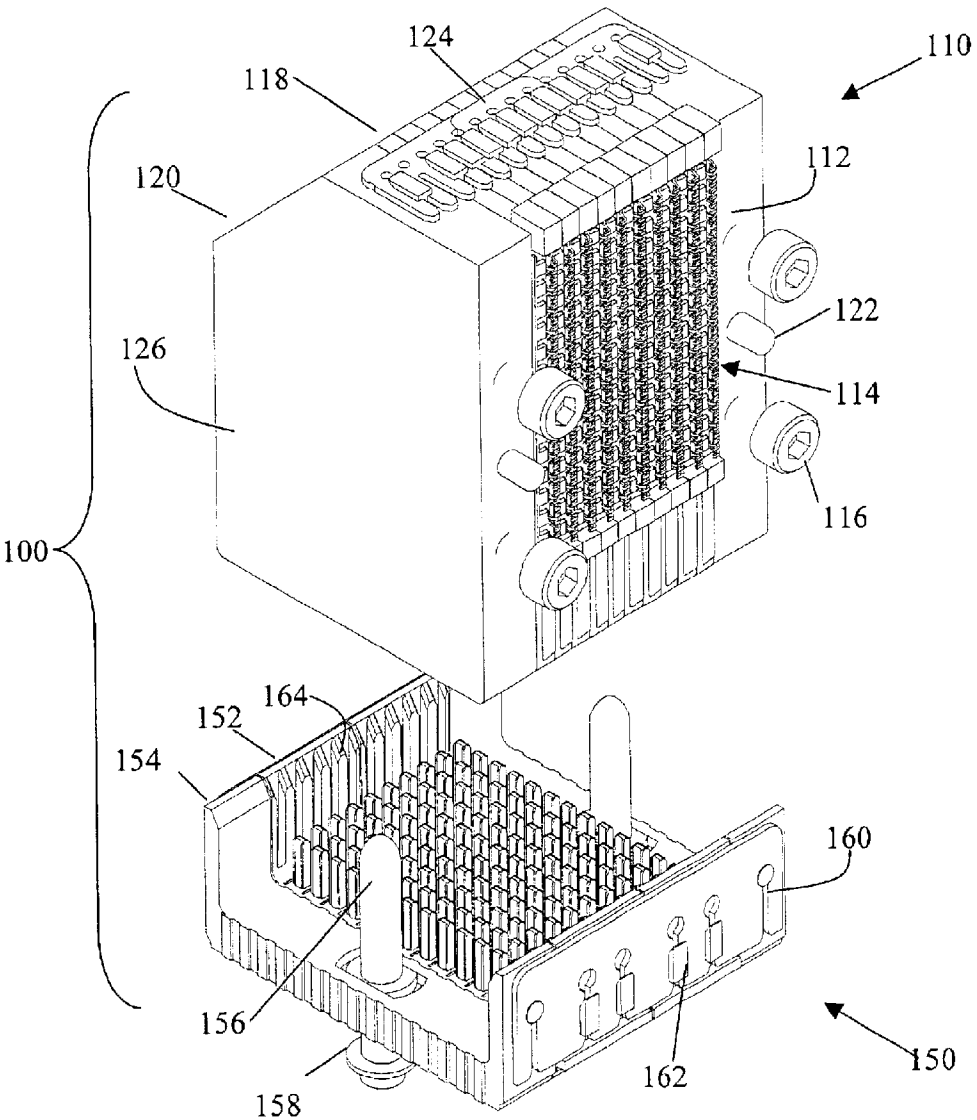
FIG. 1 is a sketch of a two-piece electrical connector.

FIG. 1 shows a connector 100. In the embodiment of FIG. 1, connector 100 is a two-piece connector. The illustrated configuration is a board to board connector, with connector 100 pictured as a right angle connector. Here connector 100 includes a daughter card connector 110 and a backplane connector 150.

Daughter card connector 110 includes a housing 126, which in the preferred embodiment is made of an insulative material. Many suitable insulative materials are known in the art. In the illustrative embodiment, the insulative housing is formed by stacking a plurality of sub-elements side-by-side. Here, the sub-elements are wafers 118 and spacers 120, which are held together by clip 124.

Clip 124 is in the preferred embodiment a metal member having features formed therein that engage complementary features on housing 126. The features are shown to be slots and hubs.

A plurality of conductive members are hold within the insulative housing. These conductive members make up contacts that carry signals, power or ground through the connector. In the illustrated embodiment, the conductive members are part of each wafer 118. Contact tails 114, which are a portion of the conductive members, extend from surface 112.

In use, surface 1112 is adapted to be mated against a printed circuit board (not shown). Contact tails 114 connect to electrical traces inside the printed circuit board, allowing electrical signals to be transmitted to or from the printed circuit board through connector 100. As pictured, contact tails 114 are surface mount contacts. Each contact tail is shaped with a flat region, such as a foot or pad. The connector can be mounted to a printed circuit board by placing solder paste on conductive pads on the surface of the printed circuit board. A silk-screening process, such as might be used to mount semiconductor devices to a printed circuit board, can be used to position the solder paste on the board, leaving what is sometimes referred to as a "brick" of solder paste.

The contact tails are positioned with each foot in a brick of solder paste. Then, the entire board assembly is heated to a temperature sufficient to melt the solder paste. This process is sometimes called "reflow." When cooled, the solder paste forms a solder joint between the contact tail of the connector and the pad in the surface of the printed circuit board, thereby making an electrical connection between the contact and traces in the printed circuit board. The solder also forms a mechanical attachment.

In the illustrated embodiment, a connector mounting mechanism is used to hold the connector in place until the solder paste is reflowed. The connector mounting mechanism uses screws 116 passing through a printed circuit board that engage connector 110, thereby holding connector 10 to the board with the force required to press the contact tails into the solder bricks during manufacture. However, the force generated should not be so strong that the contact tails displace the solder paste. If too much solder paste is displaced, there will be insufficient solder to make a reliable solder connection. Posts 122 fit into holes in the printed circuit board, thereby positioning the connector on the board and ensuring that the contact tails 114 align with solder bricks (not shown) on the surface of the printed circuit board.

In the illustrated embodiment, each contact tails also includes a curved or serpentine portion. The curve makes the contact tail "springy" or compliant. The compliance of the contact tail reduces the stress on the solder joint between the contact tail and the printed circuit board. In use, such stress might be generated by mating and unmating of connector pieces. Alternatively, it might be generated by thermal expansion or contraction. If the connector and printed circuit board expand or contract at different rates as the temperature changes, the joints between the two will be stressed.

Backplane connector 150 is adapted to mate to daughter card connector 110. In the illustrated embodiment, backplane connector 150 is made of a plurality of subassemblies. Two backplane modules 152 are shown. The backplane modules are described in greater detail in connection with FIG. 5C, below.

Each back plane module 152 preferably contains an insulative housing that carries a plurality of conductive members. Each conductive member has a portion that mates to a corresponding conductive member in the daughter cared connector 110. Each conductive member also has a contact tail that is electrically connected to a substrate, such as a printed circuit board. In this way, signals are carried through the connector from one substrate to another, such as between a backplane and a daughter card.

In the illustrated embodiment, backplane connector 150 also contains spacers 154 that align with spacers 126 in the daughter card connector 10. Backplane spacers 154 contain posts 156 that align with holes in spacers 126, thereby guiding the connector pieces into proper alignment as the two connector pieces are mated.

Spacers 154 also receive screws 158. Screws 158 hold the backplane connector to the backplane As with screws 116, screws 158 can be used to hold the connector to the board before reflow of the solder or could be added afterwards to reduce force on the solder joints during mating and unmating of the connector.

The individual subassemblies are held together. Here, clips 160 are used to hold the subassemblies together. Clips 160 have slots that engage projections, such as projections 162, formed in the housing of the subassemblies.

Each of the backplane modules 152 contains ribs 164 in its side walls. Ribs 164 create channels in the sidewalls. These channels can receive tabs or other projecting members on daughter card connector 110 to provide fine alignment of the wafers 118 with the backplane modules.

Figure 2B:
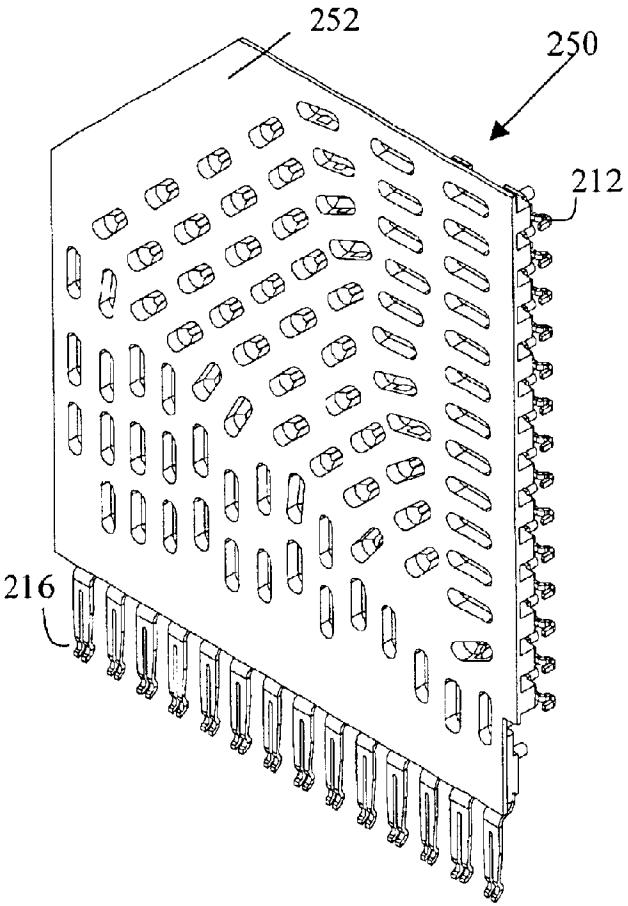
FIG. 2B is a sketch showing a signal lead subassembly used in the connector of FIG. 1.
Figure 2A:
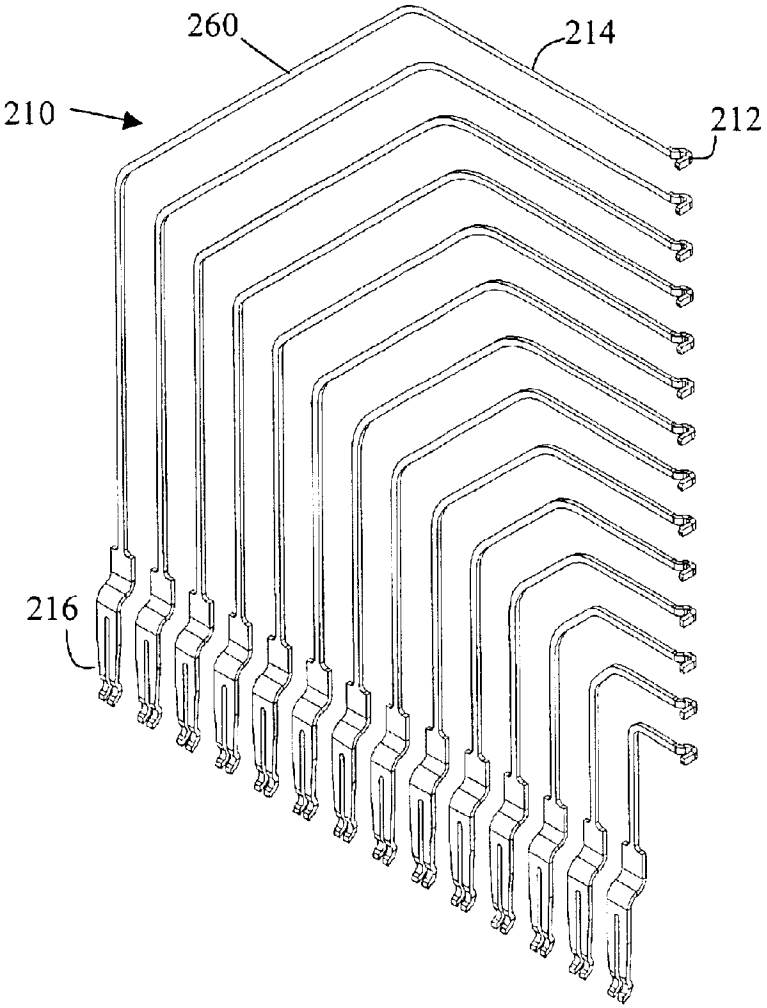
FIG. 2A is a sketch showing a signal lead frame used in the connector of FIG. 1.

Turning now to FIG. 2A, further details of the daughter card wafers are shown. In the preferred embodiment, each wafer is made up of two pieces. One piece holds a set of conductive members that are intended, in use, to carry high speed signals. For example, signals that have a switching speed of 1 to 3 GHz. A second piece of the wafer holds signal conductors that carry ground signals. For high speed signals, any conductor carrying essentially a DC signal can be considered a ground.

FIG. 2A shows a lead frame 210 used to make the signal piece of the wafer. In the illustrated embodiment, each wafer 118 contains 14 signal conductors 260. Each signal conductor 260 has a contact tail 212. In FIG. 2A, each of the contact tails is shown bent into a pad that can soldered to the surface of a substrate, such as a printed circuit board.

Further, each signal contact has a mating contact portion 216. In the illustrated embodiment, each mating contact portion is shaped into two parallel beams. The two beams provide redundant points of contact.

Each signal contact also has an intermediate portion 214. In the illustrated embodiment, the connector is a right angle connector. Therefore, the intermediate portions 214 bend through an approximately 90° angle.

In a preferred embodiment, the leadframe likely contains one or more carrier strips, holding the individual signal conductors together. Carrier strips are known in the art and are therefore not shown for clarity. During the manufacture of the connector, the carrier strips are severed from the signal contacts at a convenient time.

FIG. 2B shows the lead frame 210 formed into a signal subassembly. Preferably, subassembly 250 is formed by insert molding an insulative housing 252 around the lead frame. Insulative housing 252 holds the individual signal contacts together and also provides features that allow subassembly 250 to be attached to other pieces of the connector. Both insert molding and attachment features are known in the art. The molding operation leaves the contact tails 212 and the mating portions 216 exposed with sufficient clearance to allow them to move. Mating portions move freely to generate the required spring force to make a good electrical connection to conducting member in a mating connector. Contact tails move freely so that they can provide required compliance to prevent excessive force from being placed on the solder joints holding the tails to a substrate.

Electrical connector 100 is illustrated as a shielded connector. To incorporate shielding into wafers 118, a shield subassembly (410, FIG. 4) is formed. In the illustrated embodiment, the shielding consists of multiple ground conductors 370.

Figure 3B:
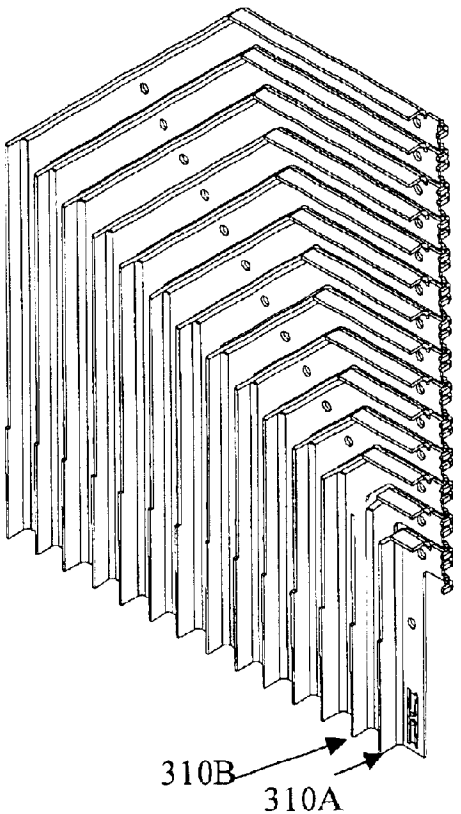
FIG. 3B is a sketch showing two shield lead frames used in the connector of FIG. 1.
Figure 3A:
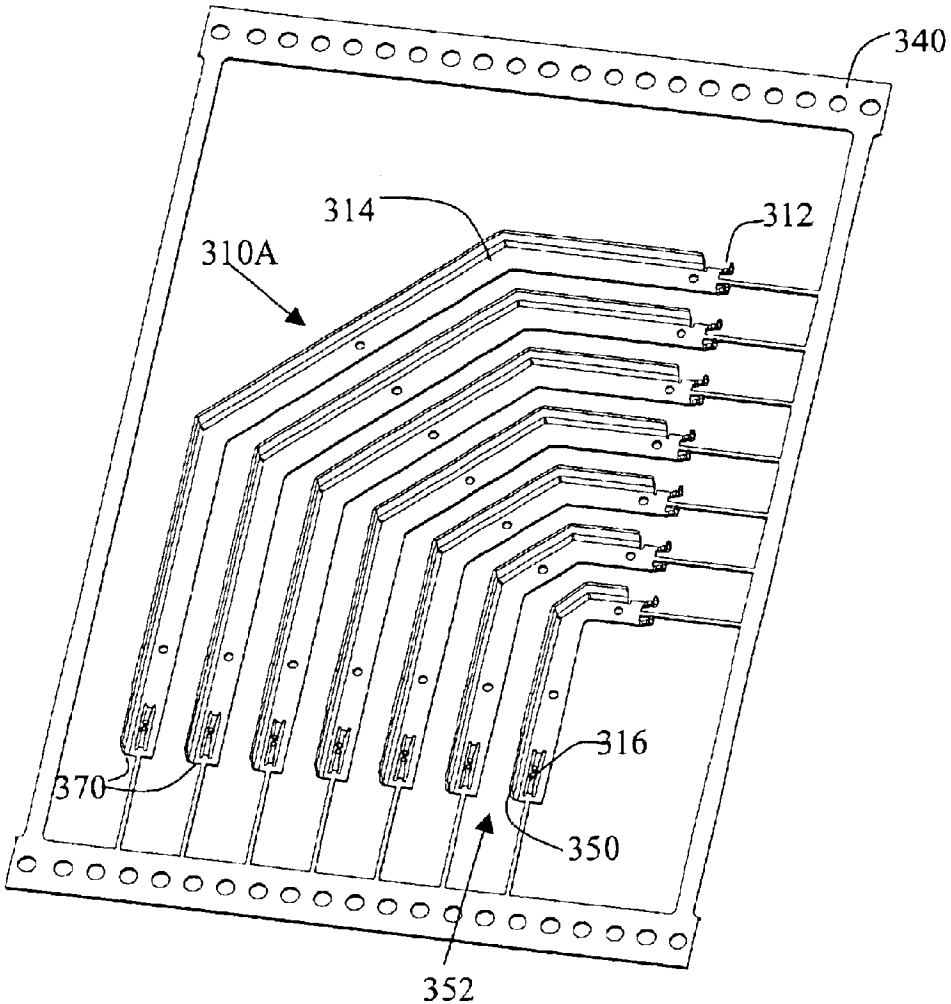
FIG. 3A is a sketch showing a shield lead frame used in the connector of FIG. 1.

FIG. 3A shows a lead frame 310A formed of multiple ground conductors 370 connected to a carrier strip 340. As with the signal conductors, each ground conductor 370 includes a conducting member to carry an electrical signal between a contact tail 312 and a mating portion 316. Mating portions 316 make electrical connection to a conductor in backplane connector 150. Preferred shapes of the mating contact portion 316 will be explained in greater detail below.

Each ground conductor 370 also has an intermediate portion 314 connecting the mating contact portion 316 with the contact tail 312. Here, each contact tail is shown to have two pads for making a surface mounted connection to a pad on a printed circuit board. Preferably, each pad will connect to a separate pad on the surface of the printed circuit board.

Each ground conductor 370 also includes a projection 350. Projection 350 is bent relative to the main body of each ground conductor and falls generally in the plane that is perpendicular to the line between adjacent ground conductors. In the preferred embodiment, each ground conductor has a generally right angle cross-section.

Lead frame 310A is preferably stamped from a continuous sheet of conductive material such as metal. The features of each ground conductor 370 are then formed. Stamping and forming can be done in one step or in multiple steps. Preferably, many lead frames are formed on a continuous strip that can be processed according to a semi-continuous process.

In the illustrated embodiment, connector 100 is a single ended connector. In a single ended connector, each signal is represented by an electrical signal on one of the signal conductors. Usually, a signal is represented by the voltage difference between a signal conductor and a reference potential, such as ground. In contrast, a differential signal connector uses two signal conductors to represent each signal. The signal is represented by the voltage difference between the two signal conductors.

In a single ended connector, it is preferable that there be shielding between a signal conductor and every other adjacent signal conductor. Shielding is provided by the ground conductors. Therefore, in the preferred embodiment, there is one ground conductor associated with each signal conductor. Also, the projections 350 are positioned to be interposed between adjacent signal conductors.

In forming projections 350 by bending the material out of the plane of the sheet used to form the ground conductor lead frame, a space 352 is left between adjacent ground conductors. Also, it should be noted that in the illustrated embodiment there are fourteen signal conductors in a lead frame 210, but only 7 ground conductors in a lead frame 310A. In order to provide one ground conductor for each signal conductor, a separate ground conductor lead frame 310B is overlaid on ground conductor lead frame 310A. Ground conductor lead frame 310B is similar to lead frame 310A in that it contains similarly shaped ground conductors. However, in lead frame 310B, the ground conductors are positioned to fit within the spaces 352 between the ground conductors of lead frame 310A.

FIG. 3B shows the ground conductors when a lead frame 310A is overlaid on a lead frame 310B. As can be seen, in this embodiment, there is one ground conductor for each signal conductor. In this configuration, an insulative housing is molded over the ground conductors to form a shield subassembly. As with the signal conductor subassembly, the insulative housing leaves the contact tails and the mating contact portions exposed.

FIG. 3B does not show the carrier strips 340. In the preferred embodiment, the carrier strips are severed after the insulative housing is molded over the conductors. However, the precise manufacturing steps are not critical to the invention and they can be performed in any convenient order.

Figure 4:
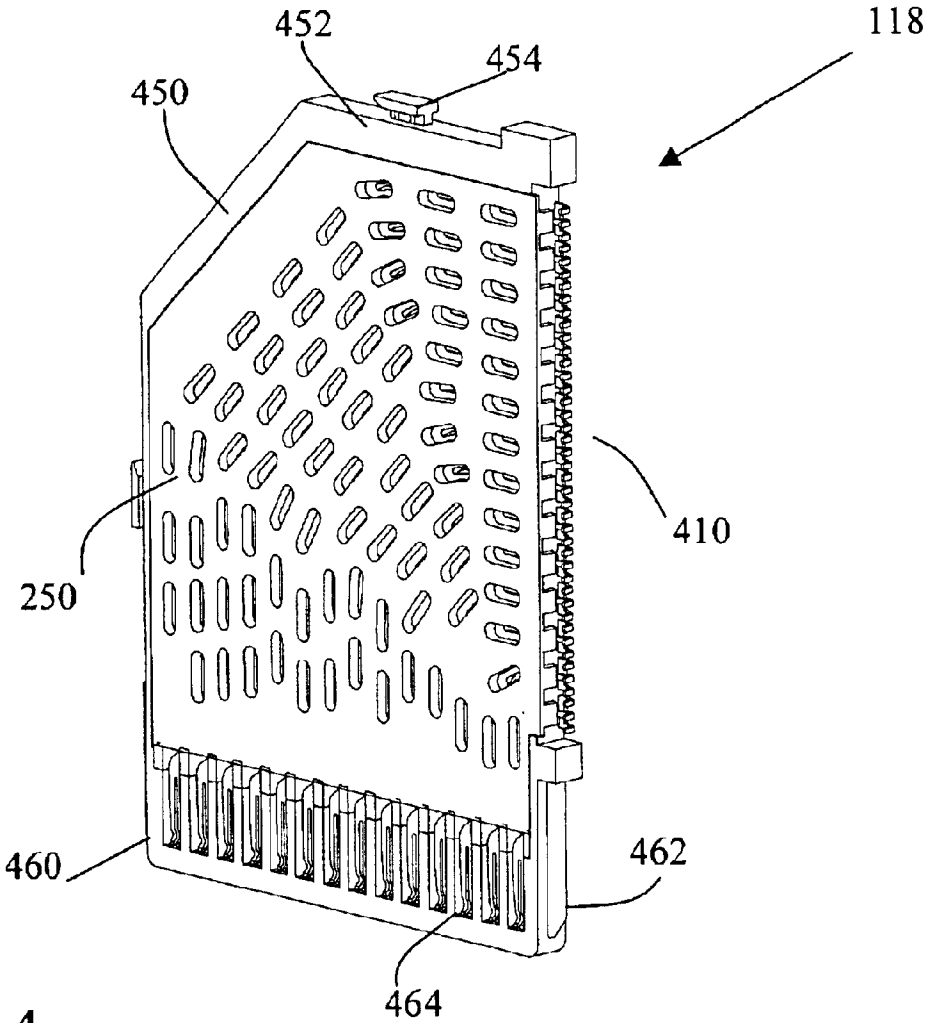
FIG. 4 is a sketch showing a wafer subassembly used in the connector of FIG. 1.

FIG. 4 shows a signal subassembly 250 and a shield subassembly 410 mated to form a wafer 118. Shield subassembly 410 has an insulative housing 450. Housing 450 includes a rear portion 452 that includes features, such as hub 454, to which clip 124 can be attached. Other such features will be included to provide mechanical properties as appropriate for the desired application of connector 100.

Housing 450 also includes a front portion 460. Front portion 460 contains openings 464 into which mating portions 216 of the signal conductors fit. As will be explained in greater detail in connection with FIG. 6A, mating contact portions 316 of the ground conductors are also accessible within openings 464. Though not visible in FIG. 4, openings 464 extend to the mating face of the connector so that projections from the mating connector can enter openings 464 and make contact with the electrical conductors of wafer 118.

Front portion 460 includes tabs 462, which fit between ribs 164 and guide the connector pieces into proper alignment when mated. Other mechanical features as appropriate for the intended application of the connector can also be molded into front portion 460.

The ground subassembly 410 and the signal subassembly 250 can be held together in any convenient matter. Preferably, attachment features are molded into the insulative housing of each subassembly. For example, snap-fit features, such as hooks and latches could be used. Alternatively, friction type attachments can be used.

Figure 5A:
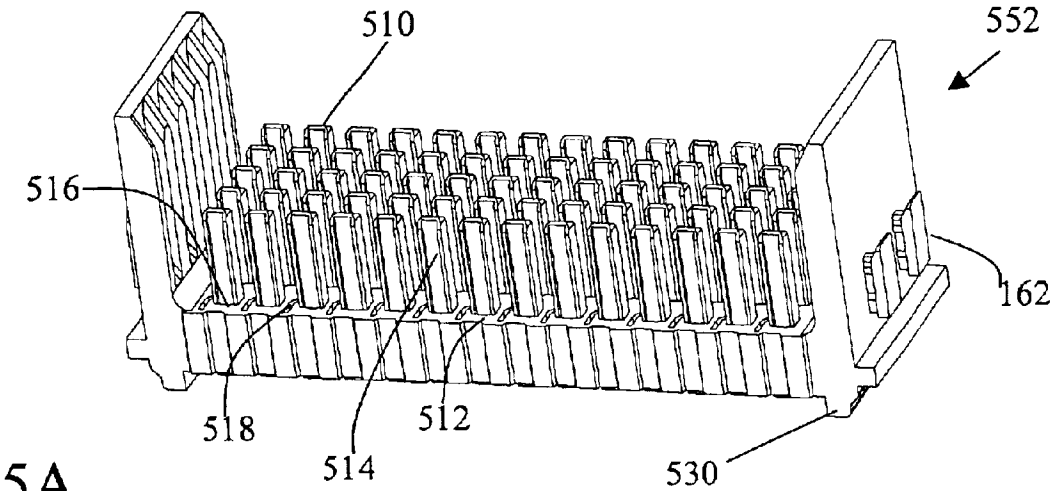
FIG. 5A is a sketch showing a backplane housing module used in the connector of FIG. 1.

Turning now to FIG. 5, FIGS. 5A . . . 5C show components of backplane connector 150. In the illustrated embodiment, each module 152 has an insulative housing 552. Preferably, the housing is molded of a plastic material.

The floor 512 has a plurality of projections 510 extending from it in the direction of a mating connector. Projections 510 have channels 514 formed on opposite sides. One channel is adapted to receive a signal conductor 560 (FIG. 5B) and the channel on the opposite face is adapted to receive a ground conductor 570 (FIG. 5C). The projections 510 are laid out in an array that matches the layout of conductive members in the mating connector. In the illustrated embodiment, the projections are laid out in a rectangular array. Each column in the array corresponds to one wafer in the mating connector.

Passages extend through floor 512 to allow the conductive members to be inserted from the lower surface of floor 512. Passages 516 receive signal conductors 560. Passages 518 receive ground conductors 570. Stand-offs 530 are molded into housing 552 to ensure that the contact tails of the conductive members are in an open area and are therefore able to move freely to provide compliant motion when a connector module 152 is soldered to a printed circuit board. During attachment of the connector to a printed circuit board, the stand-offs also prevent the contact tails from being pressed too hard into the solder bricks and displacing the solder bricks. FIG. 1 shows similar stand-offs are included on each daughter card wafer 118.

Figure 5B:
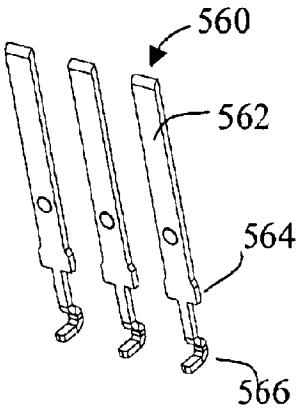
FIG. 5B is a sketch showing signal contacts used in the backplane housing module of FIG. 5A.
Figure 5C:
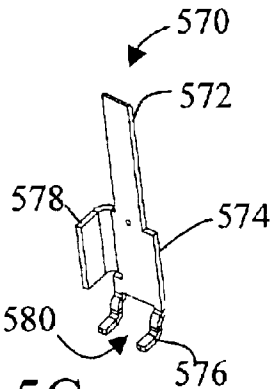
FIG. 5C is a sketch showing a ground contact used in the backplane housing module of FIG. 5A.

FIG. 5B shows signal conductors 560. For illustration, three signal conductors are shown. In a preferred embodiment, multiple signal conductors 560 will be stamped and formed from a sheet of conductive material. The signal conductors will be held together by a carrier strip (not shown) or other convenient mechanism until inserted into housing 552. Thereafter, the signal conductors will be separated as shown in FIG. 5B. Preferably, automated tooling will insert a column of signal conductors into housing 552 at one time. In the illustrated embodiment, there are fourteen signal conductors in a column.

Signal conductors 560 include a mating contact portion 562 to which a signal conductor from a mating connector mates. When inserted into housing 552, mating contact portion 562 will be in channel 514 facing outwards. More detail of conductors in the connector is provided in connection with the discussion of FIG. 6A, below.

Signal conductors 560 also include an intermediate portion 564. Intermediate portion 564 includes retention features that hold signal conductor 560 within housing 552. Examples of suitable retention features are barbs or tabs that create an interference fit inside signal opening 516.

Signal conductors 560 also include contact tails 566. When signal conductors 560 are inserted into housing 552, contact tails 566 will be exposed below floor 512. In the illustrated embodiment, the contact tails are curved to provide compliant members, similar to those used in the daughter card connector.

FIG. 5C shows a ground conductor 570. In an assembled backplane module 152, the ground conductors will be inserted into shield opening 518 in floor 512. Intermediate portion 574 is positioned within the floor 512 and holds the ground conductor 570 in the housing.

Ground conductors 570 include a mating contact portion 572. The mating contact portion will be facing outward from projection 510, thereby allowing a contact from a mating connector to make electrical connection to the ground conductor 570.

As with the other conductors, ground conductors 570 also include contact tails 576. In the illustrated embodiment, contact tails 576 are also shaped as compliant surface mount contacts. Here, two complaint members are shown with a gap 580. Preferably, each of the compliant members will align with a conducting pad on the surface of a printed circuit board. Both pads will be connected, internally to the printed circuit board, to a reference potential. As shown in more detail in FIG. 6A, a contact tail 566 from a signal conductor will be positioned in gap 580. Such a configuration provides improved electrical properties for the overall connector.

Each ground conductor 570, in the illustrated embodiment, also includes a side portion 578. The side portions bend away from the mating contact surface 572. As shown in FIG. 5A, in the assembled backplane module 152, side portions 578 are positioned between adjacent projections 510.

Preferably, there will be one ground conductor for each signal conductor 560. As shown in FIG. 5A, the ground conductors are supported by projections 510, but are on the opposite side from a signal conductor 560.

In this way, each projection 510 includes a signal conductor 560 and a ground conductor 570. Projection 510 serves to keep the signal conductor and ground conductor electrically isolated. Furthermore, the signal conductor and ground conductor have a broad dimension and a narrow dimension. The signal conductor and ground conductor are preferably held so that their broad portions are in parallel. Such an arrangement of a signal conductor and a ground conductor forms a structure similar to a microstrip transmission line. Such structures have an impedance that is controllable by adjusting the spacing between the conductors, the properties of the material that separates the conductors and the width of the conductors in the broad dimension. Preferably, these dimensions are selected to provide desired impedance properties of the connector.

In addition to providing desirable impedance properties, the microstrip transmission structures formed by signal conductors 560 and ground conductors 570 concentrate the electromagnetic fields in the region between the conductors. Concentrating the electromagnetic fields decreases the amount of signal that is coupled from one signal conductor to an adjacent signal conductor.

Side portions 578 further reduce the amount of signal coupled between adjacent signal conductors. As shown, side portions 578 extend from ground conductors 570 to a position that is between adjacent signal conductors 560. The presence of a conducting sheet connected to a reference potential can block coupling, particularly of electric fields, between adjacent signal conductors. Such shielding reduces the overall cross talk of the connector and makes it more suitable for use at high frequencies or with close spacing between signal conductors.

Figure 6B:
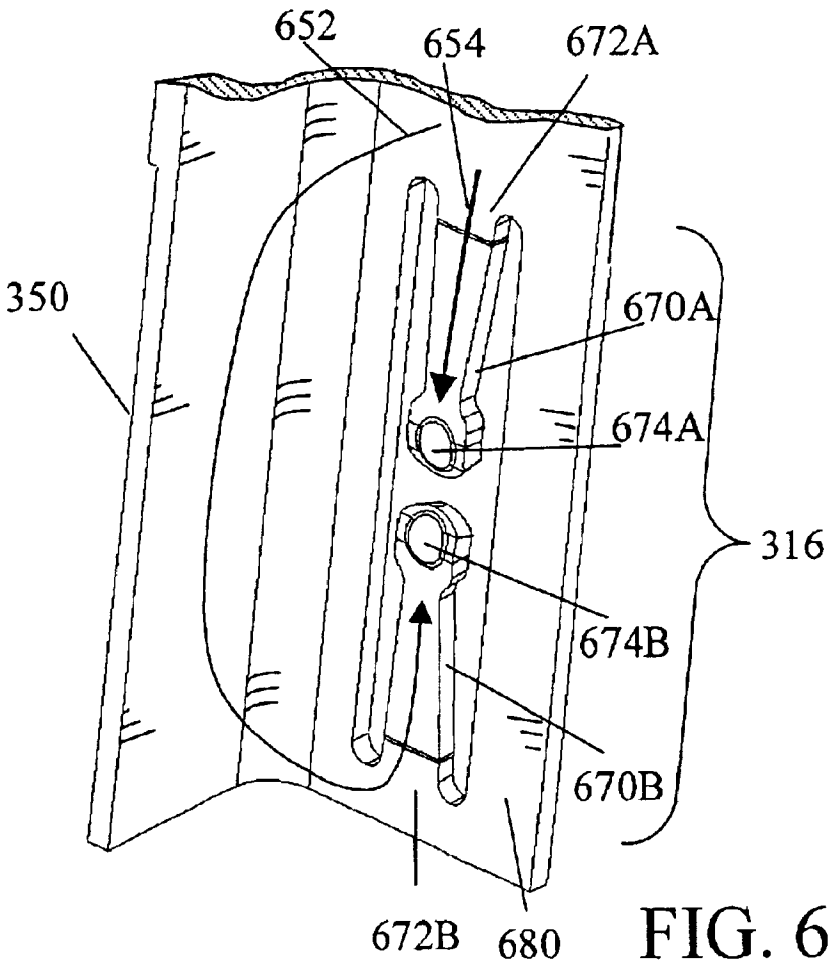
FIG. 6B is a sketch illustrating the flow of current in a ground contact when mated.
Figure 6A:
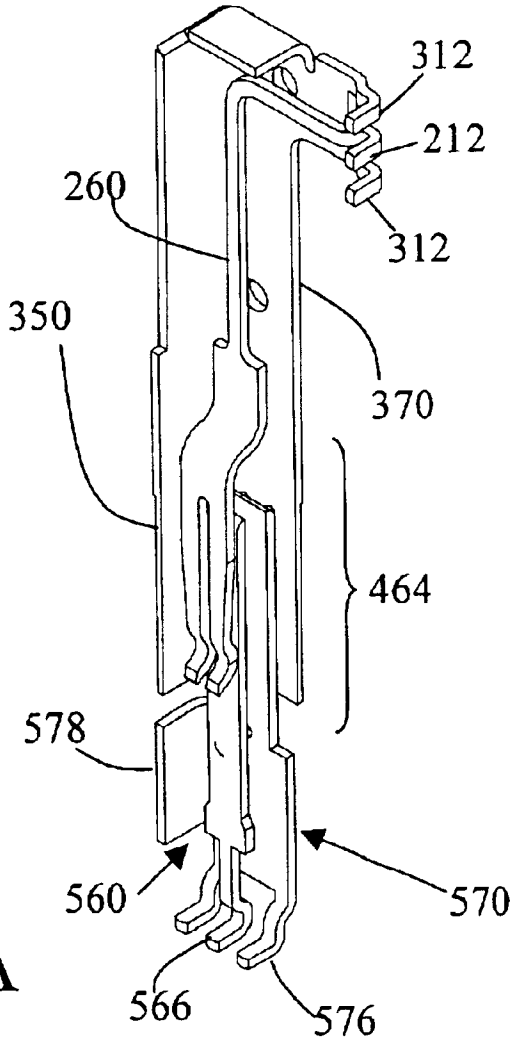
FIG. 6A is a sketch showing mated signal and ground contacts.

FIG. 6A shows the conductors in two connector halves as mated. The insulative housings of the connectors are not shown in FIG. 6A for clarity. As shown, ground conductor 370 makes electrical contact with ground conductor 570. Signal conductor 260 makes electrical contact with signal conductor 560. The contact occurs within opening 464.

As shown in FIG. 6A, the mating contacts are shaped to provide a conductive path through the connector that provides limited disruption to a signal. Such a path is said to have high signal integrity and is necessary for accurate transmission of signals, particularly high speed signals.

One feature is that the contact tails of the ground conductors are positioned on either side of the contact tails for signal conductors. This arrangement provides additional shielding in what would otherwise be a "noisy" part of the connector and therefore increases the integrity of signals passing through the connector. Thus, contact tail 212 is positioned between a pair of contact tails 312 and contact tail 566 is positioned between a pair of contact tails 576.

A second feature is that projection 350 and side portions 578 provide a nearly continuous barrier on the side of the signal contacts. As the contacts are positioned in the overall connector, this barrier falls between adjacent signal contacts in a column. The main body of ground conductors 370 and 570 provide a barrier between adjacent signal contacts in the same row of the connector.

Furthermore, the shape of mating contact portion 316 provides improved signal integrity. Contact portion 316 has multiple beams, here beams 670A and 670B. One way that having multiple beams improves signal integrity is that they create multiple current paths. In FIG. 6B, those current paths are shown as paths 652 and 654. Of particular advantage in the embodiment of FIG. 6B is the fact that path 652 diverts current into projection 350.

Projection 350 provides a physical barrier between adjacent signal conductors. And, because it is made of conductive material connected to a ground, it also acts as a barrier to electric fields. However, the effectiveness of projection 350 at blocking magnetic fields is increased if current flows through it.

By having a second beam, with a base attached to a different portion of the ground conductor, a second current flow path is created. As shown, beam 670A has a base 672A and beam 670B has a base 672B that are attached to different portions of the ground conductor.

An additional benefit of having multiple beams arises when the beams are configured to have current flow through them in opposite directions. In the configuration of FIG. 6B, each of the beams makes contact to a mating ground conductor at contact regions 674A and 674B, respectively. Each of the beams 670A and 670B has a base 672A or 672B, respectively, that is positioned on the opposite side of its respective contact region. Because current in each beam flows along a line from the base to the contact region, the current flows through the two beams in opposite directions.

A benefit of having current flows in opposite directions is that magnetic fields generated by current in the beams are in opposite directions and will tend to cancel. Canceling magnetic fields might be of a particular advantage where the conductive member is carrying a high frequency signal instead of a ground.

A further benefit of having multiple beams with current flowing in offsetting directions is that the effective inductance of the overall contact is reduced.

A further advantage of the dual beam contact is that it is relatively narrow, allowing a high density of signal conductors. In a presently contemplated commercial embodiment of a connector as pictured, the connector will have 14 rows and carry more than 120 signals per inch of connector. Connectors with 8 rows can carry more than 80 signals per inch of connector. The illustrated embodiment should carry signals with rise times of 90 picoseconds, or shorter, with less than 5% cross talk. Such specifications correspond to a data rate of greater than 5 Gbps.

An advantage of the contact structure as illustrated is that current flows through the lower portion 680 of the shield. The contact structure spreads out the flow of current in the shield member, meaning that current flows at various places across the width of the contact. A similar benefit is provided by the mating contact 570. As shown in FIG. 6A, mating contact 570 has two contact tails 576, which are widely spaced across the width of the contact. In this way, current will flow across the width of contact 570, also increasing its shielding effectiveness.

Alternatives

Having described one embodiment, numerous alternative embodiments or variations can be made.

Figure 7:
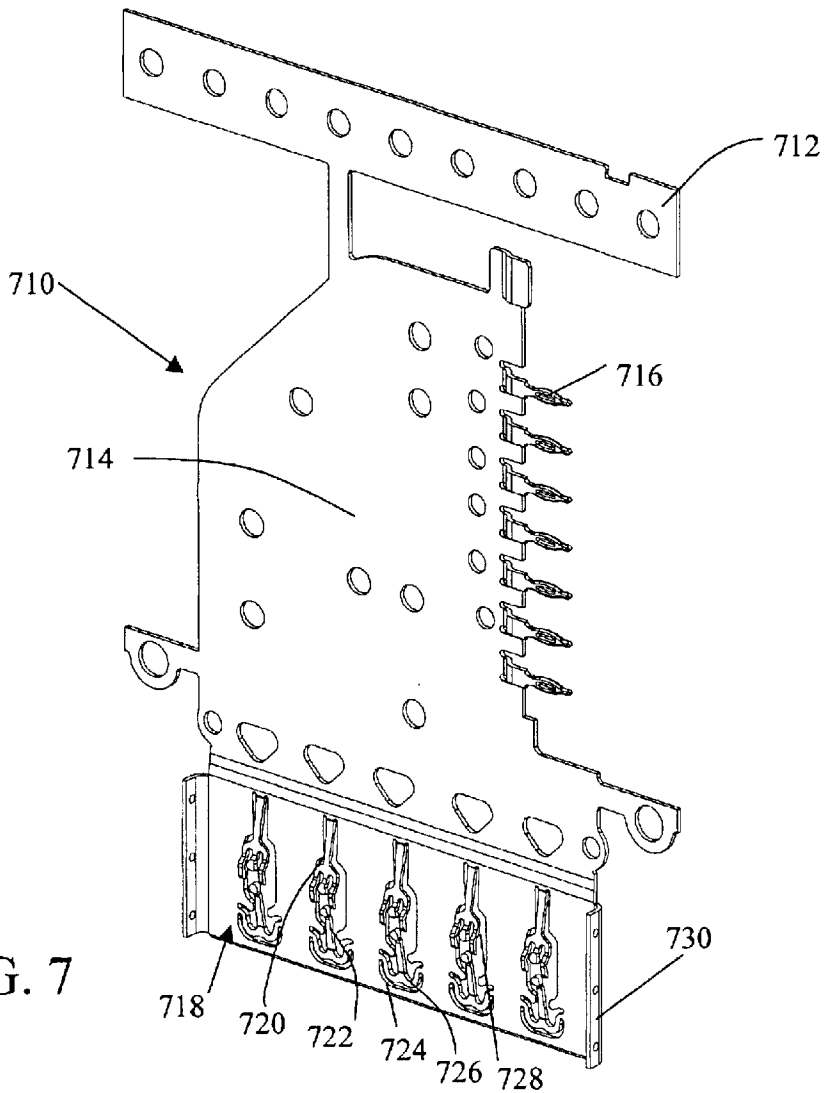
FIG. 7 is an alternative shield member that might be used in the wafer subassembly of FIG. 4.

For example, FIG. 7 shows an alternative shielding configuration. FIG. 3B shows shielding of the preferred embodiment. Multiple individual ground conductors are positioned to generally create a shield plane that is positioned between columns of signal contacts in the overall connector. The same effect could be achieved by creating a shield plane from a single sheet of conductive material.

FIG. 7 shows such a shield member 710. Here, shield member 710 is shown attached to a carrier strip 712, such as it might appear before an insulative housing is molded onto it. Shield member 710 includes a body 714 to which contact tails 716 are attached.

In this embodiment, contact tails 716 are press fit contacts. They are adapted to make mechanical and electrical connection to plated through holes in a printed circuit board to which the connector is mounted.

Shield body 714 also has a plurality of mating contacts 718 formed along one edge. In a mated connector, each of the contacts 718 might make contact to separate blade-shaped mating contacts, such as contacts 570. Alternatively, the mating contacts 718 on each of the shield plates might make connection to a shield plate running between columns of signal contacts in a mating connector. The shield configuration of FIG. 7 might be most useful in a connector designed to carry differential signals. As shown, shield plate 714 includes side projections 730, but not projections such as 350 that create a barrier between adjacent signal conductors.

The specific shape of mating contacts 718 might be employed, regardless of whether they are part of a single shield body or formed on individual ground conductors. As in the prior embodiments, each mating contact includes two beams 720 and 722.

Beam 722 is shown to have an opening 724 formed below its base. Opening 724 is shaped to leave the base of beam 722 attached to a member 726. Member 726 is attached to the overall plate at two ends and has a long axis running generally between these two ends. Member 726 forms a torsion member and can act like a torsion spring.

Beam 722 is attached to member 726. A force on beam 722 such as might be generated when it is pressed against a mating contact will tend to cause beam 722 to rotate about the axis of member 726. Member 726 will be stressed in torsion and will generate a counter force against the rotation. This counter force increases the mating Force generated by beam 722.

An advantage of using a torsional member is that the beam can be made shorter, such as less than 2 mm. For example, in a preferred embodiment, beam 722 is 70 mils (1.7 mm). In contrast, beam 720 is 130 mils (3.2 mm). Yet, beam 722 provides the required mating force. Thus, using the torsional member allows the beam to be more than 40% shorter.

Ideally, each of the beams would be as short as possible to increase the shielding effectiveness of the ground contact. The portions of a conductive member that have current flowing through it are more effective as a shield than portions that do not. The current must flow through the beam to reach the mating contact (i.e. to complete the electrical circuit). When current flows through a beam, the current is concentrated in the relatively narrow beam rather than flowing through the rest of the shield contact. Thus, keeping the beam as short as possible reduces the percentage of the length of the overall contact where the current is concentrated in the narrow beam.

In the illustrated embodiment, a torsional member is not used with beam 720 because the overall connector structure would not have sufficient mechanical integrity to meet requirements of a specific application. However, beam 720 could likewise be mounted to a torsional member for other applications.

As pictured, torsion member 726 is serpentine. Because the counter force or spring force of a torsion member is inversely proportional to its length, making torsion member 726 longer results in a torsion spring that is more compliant or less "stiff." By including bends or curves in torsion member 726, the desired spring constant for the torsion member can be achieved in a relatively small area.

FIG. 7 also shows that beam 720 has projections 728. As illustrated, beam 720 is bent out of the plane of shield plate 710. Projections 728 extend beyond the main contact in the direction of the mating connector and also bend back towards the shield plate. Projections 728 prevent beam 720 from stubbing on a mating contact while a connector containing shield plate 710 is mated to another connector.

Similar projections are not shown for beam 722 because the base of the beam faces the mating connector. As a mating contact 718 is mated with a conductor from another connector, the mating contact will slide along beam 722. Beam 722 will be pushed back into the plane of shield plate 710 and there is no abrupt protrusion from beam 722 on which the mating conductor could get caught or "stub."

Because the free end of beam 720 faces the mating connector, there is a greater risk of stubbing from beam 720. To make a good electrical connection to a mating contact, beam 720 must also be bent out of the plane of shield plate 710 sufficiently far that it will press against the mating contact when the connector pieces are mated. However, by projecting out of the plane of shield plate 710, the forward edge of beam 720 presents an abrupt surface on which a mating conductor could stub.

As the mating contact reaches beam 720, it is desirable that beam 720 be pressed back into the plane of shield plate 710 so that the mating conductor can slide along it. Projections 728 create a ramp at the leading edge of beam 720. A mating contact will slide along this ramp, pushing beam 720 out of the direct path of the mating contact. In this way, projections 728 significantly reduce the chance that a mating contact will stub on beam 720.

Similar anti-stubbing properties could be achieved by shaping the free end of beam 720 as a ramp or to otherwise have tapered lead-in like projections 728. However, including the ramps in separate projections provides performance advantages. First, because the preferred construction technique is to stamp and form the ground contacts, all of the structures for the mating contacts 718 must be cut from a single sheet of metal. As shown, projections 728 extend to the side of beam 722. They are formed from material that would otherwise have been cut out of the sheet to allow beam 722 to move freely. To include a tapered lead-in on beam 720, material between beams 720 and 722 would be needed. The ends of beams 720 and 722 would have to be far enough apart to leave sufficient material to form the taper. Conversely, by making the tapered lead-in on a projection to the side of the beam, the spacing between beams can be made smaller.

Thus, by forming the tapered lead-in of one beam to be on the side of the other beam, the points at which each beam contacts a mating connector can be made closer together. We believe that having close points of contacts reduces the areas of the shield in which there is no current flow and overall increases the effectiveness of the shield.

The illustrated configuration in which two projections are used is also preferable. Two projections means that there are two points of contacts to the mating contact. Multiple points of contact creates multiple current paths in the contact, which will also increase the shielding effectiveness of that contact. Two points of contact is shown as the preferred embodiment, representing a compromise of the number of contacts that can fit into the space available to create a high density connector of the required mechanical properties.

As an example of another variation, the opposing beams are shown with the long axes of the beams being substantially co-linear. Such an arrangement is useful when a shield plate is to mate in a relatively narrow region, such as when the plate mates with the blade. However, if more mating area is provided, the beams could be side-by-side. In such an arrangement, the long axes of the beams would be parallel such that magnetic fields associated with each beam would cancel.

Furthermore, the invention is not limited to use in making ground contacts. Signal contacts could likewise be formed with contacts as described above.

Additionally, the invention is shown having pairs of beams formed in the same conducting member. It is possible that each of the beams could be formed in a mating contact member. In this configuration, one.

Also, the invention is illustrated in a connector that uses surface mount contact tails. Other forms of contact tails might be used. Examples of other suitable contact tails are press-fit contact tails, pressure mount contact tails and solder ball contacts.

Screws 116 and 158 can be used in the case of a pressure mount contact to generate the required force to press the contact tails against the printed circuit board. It should be appreciated, though, that they are used as an illustration of a mounting mechanism and might not be used. For a surface mount connection, if alignment features such as posts 122 provide sufficient retention force to hold the connector in place until the solder is reflowed, screws might not be required. Alternatively, the screws might be added after the solder is reflowed to allow the connector to be mounted to the board in the same manufacturing step as semiconductor components. However, the screws might still be needed to prevent excessive force from building up on the solder joints holding the contact tails to the printed circuit board. Likewise, screws might be added later along with alignment features such as pins 156.

As another example, it might be possible or desirable to include features in addition to or instead of the clips in the illustrated embodiment on each of the subassemblies to hold the subassemblies together. For example, the subassemblies might be held together with snap-fit features or with some securing mechanism, such as an adhesive, or a member, such as a bolt, running through the subassemblies. As yet another variation, the subassemblies might be held in a housing or cap.

As an example of another variation, it is not necessary that the connector housings be made of insulative material. It is sometimes desirable that the housing be made partially or wholly of a conductive material. Where the housing is conductive, spacers or insulative coatings can be used to ensure that the signal conductors are not shorted together or to ground through the housing.

The ground conductors in each of the daughter card and backplane connector include side portions, or projections, such as 350 and 578. While desirable to have both, it is not necessary and a connector might be made without one or both of these projections. Likewise, benefit could still be obtained with the projections extending over only a portion of the length of the signal contact. For example, a connector might be made with only projection 350 and only in the region or opening 464 where the signal conductors mate.

It should also be appreciated that the illustrated embodiment shows ground contacts with side portions 350 on only one side to create shield strips with an L-shpaed cross section. Side portions could be included on both sides of the contact to have ground strips with a U-shaped cross section.

Such a configuration might be useful, for example, in a differential connector. In a differential connector, two signal conductors, forming a differential pair, would be placed within the "U" of the U-shaped ground conductor.

It should be appreciated that that the arrows in FIG. 6B illustrating the direction of the current flow do not necessarily correspond to the direction of the flow of electrons in an interconnection system. Because either a positive or negative voltage, if largely static, can act as a reference potential for high-speed signals, the conductive members identified as ground or reference conductors could carry currents of either polarity. Moreover, even though reference voltages are normally fixed in an interconnection system, during operation of a circuit, the magnitude or the polarity of the reference voltages might even switch.

Further, FIG. 7 shows that beam that has its free end facing a mating electrical connector has projections 728 to avoid stubbing conductors from the mating connector. The tapered shaper of the projections provides this benefit. As an alternative, a single beam might be formed on the beam itself without the need for projections. Other anti-stubbing features might be used instead. For example, the end of beam 720 might be embedded in the insulative housing 450 or otherwise protected from stubbing.

Alternatively, it is not necessary that the beams 720 and 722 or beams 670A and 670B be separated. For example, with holes 724 cut below the base of the beams leaving each beam attached to a member such as 726, beams could be stamped from a sheet of material and formed to bend out of the plane of material by deforming members 726. In this way, the upper and lower beams could remain joined, but still bend sufficiently far out of the plane of the sheet of metal to provide a good electrical connection to a conductor in a mating electrical connector. Such a contract structure would, for example, still provide the benefit of two parallel current paths through the shield and, if appropriately positioned, increase the current flow, and therefore the shielding abilities, of a projection such as 350.

Furthermore, it might not be necessary to use two beams in a contact. For example, even if beam 670A were not present in FIG. 6B, current would flow through path 652, increasing the shielding effectiveness of projection 350.

While the invention has been particularly shown and described with reference to the preferred embodiments thereof, it will be understood by those skilled in the art that various changes in form and detail may be made therein without departing from the spirit and scope of the invention.

What is claimed is:

1. An electrical connector having a plurality of conductive members and at least one ground member, the electrical connector mateable to a corresponding electrical connector and comprising:

each of the conductive members having a first contact end connectable to a printed circuit board and a second contact end mateable to the corresponding electrical connector;

the ground member having a plurality of first contact ends connectable to the printed circuit board and a plurality of second contact ends mateable to the corresponding electrical connector;

the second contact aids of the ground member having a first beam with an elongated axis and a second beam with an elongated axis;

the first beam having a fee end and an end attached to the ground member and the second beam having a free end and an end attached to the ground member; and the elongated axis of the first beam and the elongated axis of the second beam being aligned and the free end of the first beam and the free end of the second beam being directed towards one another such that electrical current flow through the first and second beams is substantially in opposite directions.

2. The electrical connector of claim 1, wherein:

the ground member further comprises an intermediate portion between the fist contact ends and the second contact ends, the intermediate portion disposed along a first plane; and the first and second beams of the ground member projecting from the first plane such that during mating to the corresponding electrical connector, the first and second beams provide spring force.

3. The electrical connector of claim 1, wherein the ground member comprises a plurality of ground conductors.

4. An electrical connector having a plurality of wafers, with each of the plurality of wafers comprising, a housing;

a plurality of signal conductors and a plurality of ground conductors disposed at least partially in the hosing, where each of the signal conductors has a first contact end connectable to a printed circuit board and a second contact end mateable to a corresponding electrical connector and each of the ground conductors has a it contact end connectable to the printed circuit board and a second contact end mateable to the corresponding electrical connector, the second contact end of the ground conductors has a first beam with an elongated axis and a second beam with an elongated axis, where the first beam includes a free end and an end attached to the ground conductor and the second beam includes a free end and an end attached to the ground conductor; and the elongated axis of the first beam and the elongated axis of the second beam are aligned and the free end of the first beam and the free end of the second beam are directed towards one another.

5. The electrical connector of claim 4, wherein the plurality of wafers are held together by a stiffening member.

6. The electrical connector of claim 4, wherein:

each of the ground conductors further comprises an intermediate portion between the first contact end and the second contact end, the intermediate portion being disposed along a first plane; and the first and second beams of the ground conductor project from the first plane such that during mating to the corresponding electrical connector, the first and second beams provide spring force.

* * * * *